US006241409B1

(12) United States Patent
Holloway et al.

(10) Patent No.: US 6,241,409 B1
(45) Date of Patent: Jun. 5, 2001

(54) PENCILS CONTAINING RECLAIMED RUBBER

(76) Inventors: Andrew Holloway, 430 Perrymont Ave., San Jose, CA (US) 95125; Vernon Gidley, 701 Technology Pl., Waverly, IA (US) 50677; John Erlandson, 2410 Travis Dr., Lebanon, IN (US) 46052

( * ) Notice: Subject to any disclaimer, the term of this patent is extended or adjusted under 35 U.S.C. 154(b) by 0 days.

(21) Appl. No.: 09/463,638

(22) PCT Filed: Jul. 21, 1998

(86) PCT No.: PCT/US98/15026

§ 371 Date: Jan. 26, 2000

§ 102(e) Date: Jan. 26, 2000

(87) PCT Pub. No.: WO99/06222

PCT Pub. Date: Feb. 11, 1999

Related U.S. Application Data

(60) Provisional application No. 60/054,008, filed on Jul. 29, 1997.

(51) Int. Cl.[7] ..... B43K 19/00
(52) U.S. Cl. ..... 401/49; 401/54
(58) Field of Search ..... 401/49, 6, 50, 401/51, 54, 96

(56) References Cited

U.S. PATENT DOCUMENTS

| | | | | |
|---|---|---|---|---|
| 141,287 | * | 7/1873 | Orndorff | 401/6 |
| 1,971,681 | * | 8/1934 | Hauton | 401/6 |
| 3,386,925 | * | 6/1968 | Dillhoefer | 260/2.3 |

* cited by examiner

*Primary Examiner*—David J. Walczak
(74) *Attorney, Agent, or Firm*—Brinks Hofer Gilson & Lione

(57) ABSTRACT

Pencils that have an outer sheath comprising a base elastomer and reclaimed rubber for enclosing an inner marking core therein. The base elastomer provides a vulcanizate with basic physical and environmental resistant properties including at a minimum elasticity, flexibility, and relative impermeability to water and air while the reclaimed rubber advantageously extends the base elastomer to reduce cost and help reduce quantities of existing environmentally harmful waste. By not incorporating wood in the sheath, the present invention does not contribute to deforestation or consumption of a natural resource, but to the contrary, describes an efficient use for used tires. In addition, the pencils of the present invention are easier to manufacture than wooden pencils and generate less health hazards.

26 Claims, No Drawings

PENCILS CONTAINING RECLAIMED RUBBER

This application is a 371 of PCT/US98/15026 filed Jul. 21, 1998, which claims the benefit of Provisional No. 60/054,008 Jul. 29,1997.

BACKGROUND OF THE INVENTION

The present invention relates generally to writing elements, and more particularly, to durable pencils that minimize negative impacts on the environment and, in fact, generate a positive impact on the environment during manufacture and in use and, as such, are "environmentally friendly."

Conventional pencils that are presently manufactured typically contain a graphite or pigmented lead core inside a wooden sheath. The pencils presently available are unsatisfactory for a number of reasons. For example, the current process for making wooden pencils, which entails laying an extruded graphite insert in a groove longitudinally extending in one half of the wooden sheath, is expensive and requires considerable work and special conditions. The sheath-half containing the graphite insert and the corresponding opposite sheath-half are then coated with an adhesive such as glue and pressed to fit together until dried and set and then undergo a lacquering operation. This process is expensive, requires multiple steps, and is time consuming. For example, lacquering is very labor and time intensive and requires approximately four to twelve passes through a paint line to achieve a desired coating. Consistency in areas such as diameter, length and quality is difficult to achieve and will not only contribute to "down time" during manufacture of wooden pencils but will also translate into the imprinting and decorating market.

As a natural substance, wood is a limited resource and varies widely in composition and properties. Deforestation of woods and rain forests is a significant drawback with wooden pencils. Also, only certain types of wood possess the requisite properties to be used in the manufacture of pencils and those wood varieties are generally expensive. Cedar is most commonly used, although basswood, pine and jelutong are sometimes used in pencil manufacture, especially those pencils manufactured overseas.

Manufacture and use of wooden pencils can also cause health hazards. By way of example, sawdust and other scraps are generated during the pencil manufacturing process, especially during the grooving and shaping of the wooden sheath. As a result, a dust collector is used to collect the sawdust and can cause respiratory problems if not handled correctly. Further, disposal of the scrap product continues to be a problem. In addition, because of the nature of wood, changes in humidity and temperature can cause problems such as warping. Warping, in turn, creates problems in the gluing, shaping and lacquering stages of manufacture and can result in an increase in the amount of scraps generated by as much as one percent or two percent. While in use, pencils having wood casings are also subject to splintering when broken thereby posing a danger, especially to young children.

From the foregoing, it will be appreciated that there exists a need in the art for pencils that do not contribute to the deforestation of the woods and rain forest, and which can be manufactured relatively inexpensively without generating sizable quantities of scraps while minimizing health hazards in manufacture and in use. It will be appreciated that there also exists a need for pencils that are relatively durable, with a heavier weight and that will not easily break.

SUMMARY OF THE INVENTION

The aforesaid problems are solved, in accordance with the present invention, by pencils having an inner marking core surrounded by an outer sheath that comprises reclaimed rubber. Preferably, the reclaimed rubber is in the form of, for example, reground tires or rubber scrap that can be treated to allow for a more compatible bond with surrounding matrix or, preferably, untreated. A base elastomer, such as natural rubber, synthetic isoprene, SBR, butyl, butadiene, EPDM, EPM, chloroprene, nitrile, thiokol®, urethane, silicone, acrylic, fluorocarbon, epichlorohydrin, chlorinated polyethylene, or chlorosulfonated polyethylene can be used in conjunction with the reclaimed rubber. The base elastomer provides a vulcanizate with basic physical and environmentally resistant properties of, at a minimum, elasticity, flexibility and relative impermeability to water and air, while the reclaimed rubber extends the base elastomer to reduce cost while reducing environmentally harmful waste, as perhaps in the form of used tires. In addition to the reclaimed rubber and the base elastomer, one or more fillers, plasticizers, reinforcing resins, antidegradants, processing aids, activators, accelerators, scorch retarders, and vulcanizing agents can be included in the pencils of the present invention, as desired.

Advantageously, the writing instruments of the present invention made from reclaimed rubber eliminate the need for consuming a limited resource, namely trees, while at the same time incorporate a use for used tires which clutter the countryside with unsightly waste, which constitute extremely dangerous fire hazards in their original form and which make poor landfill. The pencils comprising reclaimed rubber under the present invention not only address the above environmental concerns, but also possess a heavier weight and elastomeric surface which give an enhanced "feel" of a premium writing instrument.

Unlike the traditional wooden pencil, the pencils of the present invention comprising reclaimed rubber do not splinter when broken and therefore do not pose a danger to young children. In fact, under most circumstances, the pencils of the present invention are almost impossible to break. Although the rigid graphite filler might break when bent, the rubber case will not break unless cooled to −32° F.(≈−35.6° C.). During manufacture, sizable quantities of scraps are not generated as is the case in the wooden pencil industry. The rubber pencils of the present invention also eliminate major downtime during manufacture, thereby creating a more cost-effective product.

The present invention will be more fully understood upon reading the following detailed description of the preferred embodiment.

DETAILED DESCRIPTION OF THE PREFERRED EMBODIMENTS

The following portion of the specification sets forth the preferred embodiments of the present invention. The embodiments of the invention disclosed herein include the best mode contemplated by the inventors for carrying out their invention in a commercial environment, although it should be understood that various modifications can be accomplished within the parameters of the present invention.

In accordance with the present invention, reclaimed rubber is combined with a base elastomer to produce a pencil sheath for surrounding an inner marking core. The base elastomer is selected to provide a vulcanized composition with essential physical and environmental resistant properties of, at a minimum, elasticity, flexibility and relative impermeability to water and air. Examples of suitable base elastomers include, but are not limited to, natural rubber or synthetic rubber. Examples of synthetic rubber that are suitable for inclusion in the base elastomer include, but are not limited to, synthetic isoprene, styrene-butadiene (SBR), butyl such as isobutene-isoprene, butadiene, terpolymer of ethylene, propylene and a diene with the residual unsaturated portion of the diene in the side chain (EPDM), EPM copolymer, chloroprene, nitrile, thiokol®, urethane, silicone, acrylic such as copolymers of ethyl or other acrylate and a small amount of monomer which facilitates vulcanization, fluorocarbon such as fluoro rubber of the polymethylene type having substituent fluoro and perfluoroalkyl or perfluoroalkyoxy groups on the polymer chain, polychloromethyl oxirane (epichlorohydrin polymer), chlorinated polyethylene, bromobutyl such as bromo-isobutene-isoprene, chlorobutyl such as chloro-isobutene-isoprene and chlorosulfonated polyethylene. Natural rubber is a most preferred base elastomer. It is noted that, under the present invention, more than one base elastomer can be used to form a cumulative base elastomer component of the pencil sheath.

Reclaimed rubber, which can be in the form of, for example, reground tires or rubber scrap which is treated or untreated, is provided to extend the base elastomer component to reduce cost and to help reduce quantities of existing environmentally harmful waste. The reclaimed rubber is preferably present in an amount ranging from approximately 10% to approximately 75% by weight of the pencil sheath, while the base elastomer is preferably provided in an amount ranging from approximately 10% to approximately 50% by weight of the pencil sheath. One of ordinary skill in the art will appreciate that a number of other ingredients can be included in the pencils of the present invention, as described below. One or more reinforcing and/or one or more extending fillers can also be included in the pencils of the present invention in order to enhance or reinforce the physical properties of the pencil sheaths as in the case of reinforcing types of fillers, or to lower costs as in the case of extending types of fillers. Examples of reinforcing fillers include, but are not limited to, carbon black, silica, zinc oxide, magnesium carbonate, aluminum silicate, sodium aluminosilicate, and magnesium silicate, while examples of extending types of fillers include, but are not limited to, calcium carbonate, barium sulfate, aluminum trihydrate, talc, and soapstone. The fillers are preferably provided in an amount ranging from approximately 5% to approximately 45% by weight of the pencil sheath.

One or more plasticizers can be added to the pencils under the present invention in order to soften and/or vulcanize the mixture, facilitate improved mixing, lower cost, modify viscosity, produce tack, and provide flexibility at lower temperatures for the pencils. Examples of suitable plasticizers include, but are not limited to, petroleum hydrocarbons, esters, vulcanized vegetable oils, asphaltic hydrocarbons, pine tar and resins. The plasticizer content of the pencils of the present invention preferably ranges from approximately 0.5% to approximately 25% by weight of the pencil sheath.

One or more reinforcing resins can be included in the pencils of the present invention in order to increase hardness, increase strength, reduce flex cracking, build tack, reduce cut growth and aid in processing. Examples of suitable reinforcing resins include, but are not limited to, styrene butadiene, phenolic and hydrocarbons. The reinforcing resin is preferably provided in an amount ranging from approximately 2% to approximately 35% by weight of the pencil sheath.

The pencil sheath of the present invention can also include one or more antidegradants in order to retard the deterioration of rubber or other base elastomer compounds initiated by oxygen, ozone, heat, light, metal catalysis, and mechanical flexing. Examples of suitable antidegradants, include, but are not limited to, hindered phenols, hindered bisphenols, hindered thiobisphenols hydroquinones, phosphites, diphenylamines, naphthylamines, quinolines, carbonyl-amines and paraphenylenediamines. Antidegradants can be included in the present invention in an amount ranging from approximately 0.001% to approximately 2% by weight of the pencil sheath.

One or more processing aids can also be included in the pencils of the present invention in order to facilitate processing operations, such as mixing, extruding, calendaring, and molding. Examples of suitable processing aids include, but are not limited to, activated dithio-bisbenzanilide, poly-paradinitrosobenzene, xylyl mercaptans, low-molecular-weight polyethylene, calcium oxide, aliphatic-napthinic-aromatic resins, paraffin wax, polyethylene glycol and petroleum hydrocarbon. The processing aids can be included in the pencil sheaths of the present invention in an amount ranging from approximately 0.2% to approximately 10% by weight of the pencil sheath.

Activators can be included in the pencil sheaths of the present invention in order to activate accelerators to improve effectiveness and performance of the pencils. Examples of activators include, but are not limited to, zinc oxide, stearic acid, litharge, magnesia and amines. Activators can be included in the pencils of the present invention in an amount ranging from approximately 0.2% to approximately 15% by weight of the pencil sheath.

Accelerators can be incorporated into the pencils of the present invention in order to reduce cure time of the sheaths by increasing the speed of vulcanization. Examples of suitable accelerators include, but are not limited to, aldehyde-amine, amines, guanidines, thioureas, thiazoles, thiurams, sulfenamides, dithiocarbamates, xanthates, litharge, lime and magnesia. The accelerators can be included in the present invention in an amount ranging from approximately 0.2% to approximately 10% by weight of the pencil sheath.

Scorch retarders can also be included in the pencils of the present invention in order to increase the time necessary to reach scorch point by retarding the onset of vulcanization. Examples of suitable scorch retarders include, but are not limited to, phthalic anhydride, salicylic acid, sodium acetate and cyclohexyl-N-thiophthalamide. The scorch retarders can be included in the pencils of the present invention in an amount ranging from approximately 0.02% to approximately 2% by weight of the pencil sheath.

Vulcanizing agents can be included in the pencils of the present invention in order to cause a chemical reaction that results in cross-linking of the elastomeric molecules. Examples of suitable vulcanizing agents include, but are not limited to, sulfur, organic peroxides, metallic oxides, organic amines and phenolic resins. The vulcanizing agents can be included in the pencils of the present invention in an amount ranging from approximately 0.01% to approximately 20% by weight of the pencil sheath. Examples of specific embodiments under the present invention are provided in Tables I and II. It will be understood that these examples are meant as examples and do not limit the invention. It is noted for clarity of description that the listed ingredients are identified in the Blue Book: *Materials, Compounding Ingredients, Machinery and Services for Rubber*, Published by Lippincott and Peto, Inc. (1997).

Preferably, the pencils of the present invention are manufactured by compression molding. One of ordinary skill in the art will appreciate, however, that the pencils of the present invention can also be formed in alternative ways, such as extrusion, injection or transfer molding. For example, the pencils can be manufactured by forming an extruded pole which is cured into the sheath with graphite then inserted therein. An alternative extrusion method entails extruding the sheath and then drilling a channel for receiving inserted graphite, or the sheath can be coextruded with the graphite. Alternatively, the pencil sheaths can be formed by injection, compression or transfer molding of the sheath with the graphite inserted as a finished product. Also, the injection, compression or transfer molding can occur with the graphite added in a second operation. Yet another alternative for manufacturing the pencils is to injection, compression or transfer mold the sheath as a slab, which is assembled with the graphite, and then cut into individual products. In order to insure that the graphite does not detach itself from the sheath, a compatible rubber cement is applied to the graphite prior to insertion into the molding process. This allows for a chemical bond that will hold the graphite in plate even if the pencil is bent to the point where the graphite severs. This keeps the graphite from falling out of the pencil in small pieces as often occurs with wood pencils.

While the preferred embodiment of the invention has been disclosed, it should be appreciated that the invention is susceptible of modification without departing from the spirit of the invention or the scope of the subjoined claims.

What is claimed is:

1. A pencil having an inner marking core and an outer sheath comprising reclaimed rubber and at least one base elastomer selected from the group consisting of natural rubber and synthetic rubber.

2. A pencil as defined in claim 1 wherein the reclaimed rubber is present in an amount ranging from approximately 10% by weight to approximately 75% by weight, and wherein the base elastomer is present in an amount ranging from approximately 10% by weight to approximately 50% by weight of the sheath.

3. A pencil as defined in claim 1 wherein the sheath further comprises at least one filler that is present in an amount ranging from approximately 5% by weight to approximately 45% by weight of the sheath.

4. A pencil as defined in claim 3 wherein the filler comprises at least one reinforcing type of filler selected from the group consisting of carbon black, silica, zinc oxide, magnesium carbonate, aluminum silicate, sodium aluminosilicate, magnesium silicate and combinations thereof.

5. A pencil as defined in claim 3 wherein the filler comprises at least one extending type of filler selected from the group consisting of calcium carbonate, barium sulfate, aluminum trihydrate, talc, soapstone and combinations thereof.

6. A pencil as defined in claim 1 wherein the sheath further comprises at least one plasticizer which is present in an amount ranging from approximately 0.5% by weight to approximately 25% by weight of the sheath.

7. A pencil as defined in claim 6 wherein the plasticizer is selected from the group consisting of petroleum hydrocarbons, esters, vulcanized vegetable oils, asphaltic hydrocarbons, pine tar, resins and combinations thereof.

8. A pencil as defined in claim 1 wherein the sheath further comprises at least one reinforcing resin that is present in an amount ranging from approximately 2% by weight to approximately 35% by weight.

9. A pencil as defined in claim 8 wherein the reinforcing resin is selected from the group consisting of styrene butadiene, phenolic, hydrocarbons and combinations thereof.

10. A pencil as defined in claim 1 wherein the sheath further comprises at least one antidegradant which is present in an amount ranging from approximately 0.001% by weight to approximately 2% by weight.

11. A pencil as defined in claim 10 wherein the antidegradant is selected from the group consisting of hindered phenols, hindered bisphenols, hindered thiobisphenols hydroquinones, phosphites, diphenylamines, naphthylamines, quinolines, carbonyl-amines, paraphenylenediamines and combinations thereof.

12. A pencil as defined in claim 1 wherein the sheath further comprises at least one processing aid which is present in an amount ranging from approximately 0.2% by weight to approximately 10% by weight.

13. A pencil as defined in claim 12 wherein the processing aid is selected from the group consisting of activated Dithiobisbenzanilide, poly-paradinitrosobenzene, xylyl mercaptans, low-molecular-weight polyethylene, calcium oxide, aliphatic-napthinic-aromatic resins, paraffin wax, polyethylene glycol, petroleum hydrocarbon and combinations thereof.

14. A pencil as defined in claim 1 wherein the sheath further comprises as least one activator which is present in an amount ranging from approximately 0.2% by weight to approximately 15% by weight.

15. A pencil as defined in claim 14 wherein the activator is selected from the group consisting of zinc oxide, stearic acid, litharge, magnesia, amines and combinations thereof.

16. A pencil as defined in claim 1 wherein the sheath further comprises at least one accelerator which is present in an amount ranging from approximately 0.2% by weight to approximately 10% by weight.

17. A pencil as defined in claim 16 wherein the accelerator is selected from the group consisting of aldehyde-amine, amines, guanidines, thioureas, thiazoles, thiurams, sulfenamides, dithiocarbamates, xanthates, litharge, lime, magnesia and combinations thereof.

18. A pencil as defined in claim 1 wherein the sheath further comprises at least one scorch retarder that is present in an amount ranging from approximately 0.02% by weight to approximately 2% by weight.

19. A pencil as defined in claim 18 wherein the scorch retarder is selected from the group consisting of phthalic anhydride, salicylic acid, sodium acetate, cyclohexyl-N-thiophthalamide and combinations thereof.

20. A pencil as defined in claim 1 wherein the sheath further comprises at least one vulcanizing agent that is present in an amount ranging from approximately 0.01% by weight to approximately 20% by weight.

21. A pencil as defined in claim 20 wherein the vulcanizing agent is selected from the group consisting of sulfur, organic peroxides, metallic oxides, organic amines, phenolic resins and combinations thereof.

22. A pencil as defined in claim 1 wherein the reclaimed rubber is formed from reground tires.

23. A pencil as defined in claim 1 wherein the base elastomer is selected from the group consisting of natural rubber, synthetic isoprene, SBR, butyl, butadiene, EPDM, EPM, chloroprene, nitrile, thiokol®, urethane, silicone, acrylic, fluorocarbon, epichlorohydrin, chlorinated polyethylene, chlorosulfonated polyethylene, halogenated butyl or combinations thereof.

24. An outer sheath for enclosing an inner marking core of a pencil comprising:

at least one base elastomer which is present in an amount ranging from approximately 10% by weight to approximately 50% by weight;

at least one filler which is present in an amount ranging from approximately 5% to approximately 45% by weight;

at least one plasticizer which is present in an amount ranging from approximately 0.5% by weight to approximately 25% by weight;

at least one reinforcing resin which is present in an amount ranging from approximately 2% by weight to approximately 35% by weight;

at least one antidegradant which is present in an amount ranging from approximately 0.001% to approximately 2% by weight;

at least one processing aid which is present in an amount ranging from approximately 0.2% by weight to approximately 10% by weight;

at least one activator which is present in an amount ranging from approximately 0.2% by weight to approximately 15% by weight;

at least one accelerator which is present in an amount ranging from approximately 0.2% by weight to approximately 10% by weight;

at least one scorch retarder which is present in an amount ranging from approximately 0.2% to approximately 2% by weight;

at least one vulcanizing agent which is present in an amount ranging from approximately 0.01% by weight to approximately 20% by weight; and reclaimed rubber that is present in an amount ranging from approximately 10% by weight to approximately 75% by weight.

25. An outer sheath for a pencil as defined in claim 24 wherein:

the base elastomer is selected from the group consisting of natural rubber, synthetic isoprene, SBR, butyl, butadiene, EPDM, EPM, chloroprene, nitrile, thiokol®, urethane, silicone, acrylic, fluorocarbon, epichlorohydrin, chlorinated polyethylene, halogenated butyl, chlorosulfonated polyethylene or combinations thereof;

the filler is selected from the group consisting of carbon black, silica, zinc oxide, magnesium carbonate, aluminum silicate, sodium aluminosilicate, magnesium silicate, calcium carbonate, barium sulfate, aluminum trihydrate, talc and soapstone, or combinations thereof;

the plasticizer is selected from the group consisting of petroleum hydrocarbons, esters, vulcanized vegetable oils, asphaltic hydrocarbons, pine tar and resins or combinations thereof;

the reinforcing resin is selected from the group consisting of styrene butadiene, phenolic and hydrocarbons or combinations thereof;

the antidegradants are selected from the group consisting of hindered phenols, hindered bisphenols, hindered thiobisphenols hydroquinones, phosphites, diphenylamines, naphthylamines, quinolines, carbonyl-amines and paraphenylenediamines or combinations thereof;

the processing aid is selected from the group consisting of activated Dithio-bisbenzanilide, poly-paradinitrosobenzene, xylyl mercaptans, low-molecular-weight polyethylene, calcium oxide, aliphatic-napthinic-aromatic resins, paraffin wax, polyethylene glycol and petroleum hydrocarbon or combinations thereof;

the activator is selected from the group consisting of zinc oxide, stearic acid, litharge, magnesia and amines or combinations thereof;

the accelerator is selected from the group consisting of aldehyde-amine, amines, guanidines, thioureas, thiazoles, thiurams, sulfenamides, dithiocarbamates, xanthates, litharge, lime and magnesia or combinations thereof;

the scorch retarder is selected from the group consisting of phthalic anhydride, salicylic acid, sodium acetate, cyclohexyl-N-thiophthalamide or combinations thereof; and the vulcanizing agent is selected from the group consisting of sulfur, organic peroxides, metallic oxides, organic amines and phenolic resins or combinations thereof.

26. An outer sheath for a pencil as defined in claim 24 wherein the reclaimed rubber is formed from reground tires.

* * * * *